United States Patent [19]

Kauffman

[11] 4,022,225

[45] May 10, 1977

[54] COIL CURLER

[76] Inventor: Robert T. Kauffman, 6495 Broadway, New York, N.Y. 10471

[22] Filed: June 4, 1976

[21] Appl. No.: 692,796

[52] U.S. Cl. ..... 132/31 R; 132/34 C; 132/43 R

[51] Int. Cl.[2] ..... A45D 2/00

[58] Field of Search ..... 132/31 R, 43 R, 43 A, 132/9, 7, 33, 40, 34 C

[56] References Cited

UNITED STATES PATENTS

| | | | |
|---|---|---|---|
| 2,166,386 | 7/1939 | Auster | 132/43 A |
| 2,590,669 | 3/1952 | Zachary | 132/33 R |
| 2,720,207 | 10/1955 | Burtnett | 132/43 R |
| 2,889,834 | 6/1959 | Anderson et al. | 132/7 |
| 3,109,437 | 11/1963 | Broyles | 132/9 |

*Primary Examiner*—G.E. McNeill

[57] ABSTRACT

In a preferred embodiment, an elongated tape rigid in a width direction and flexible in a length direction, having an elongated coil spring embodied therein extending its length, with adjustable clamps at one end thereof for anchoring around hair to be curled.

2 Claims, 3 Drawing Figures

COIL CURLER

This invention relates to a roll-up type hair curler for curling of the hair.

BACKGROUND OF THE INVENTION

Prior to the present invention there have been almost unlimited varieties of hair curlers, and of the roll-up type there have been various attaching means including hair pins, ribbons, and the like, after manually rolling the hair thereupon. All such has been very time consuming, and although the years have gone by, there therefore have not been developed any real solutions to the problem of difficulty and delay and wasted time in the mounting thereof.

SUMMARY OF THE INVENTION

Accordingly, objects of the present invention include the overcoming of difficulties and disadvantages associated with prior roll-up curlers, together with other advantages as are set forth herein below.

Other objects become apparent from the preceding and following disclosure.

The objects are obtained by the invention as disclosed herein.

Broadly the invention may be described as a hair curler of an elongated roll-up type having an elongated tape element. The tape element is substantially rigid along its width axis and substantially flexible along its length axis, as typically effected by ribs extending width-wise and a cover of flexible nature encasing the ribs. Also enclosed or otherwise mounted on the cover, is a spring. The spring in one embodiment extends as an elongated coil spring mounted along the length of the flexible cover, such that it may be extended to thereupon place hair in a position on the inwardly-coiling surface of the cover and then permit the spring-biased cover to roll-up upon the hair, thus positioning it for curl, with a free-end clamped around a tuft of hair.

In an alternative embodiment, there may be a finger handle attached to a spring having a spool structure or the like anchored to the other end of the spring such that, in the nature of a tape-measure or window shade rod, the coiled tape may be extended prior to anchoring the hair thereupon, and then the finger-gripped handle is moved slowly upward toward the head, permitting the spool to windup to thus retrace the enlongated tape and simultaneously curl-up the hair, followed by bending anchoring clamps around the hair to prevent unwinding of the rolled-up hair. In this embodiment, it is advantageous thus to have clamps on the tape at one end, — the extended end, and additional clamps on the handle.

The invention may be better understood by making reference to the following Figures.

THE FIGURES

DETAILED DESCRIPTION

Figure 1:
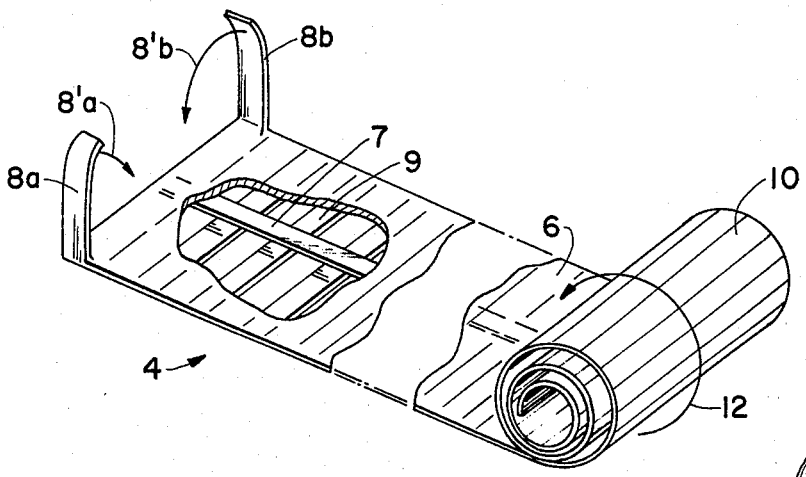
FIG. 1 illustrates a partially extended roll-up curler of one embodiment of the invention, shown in side end perspective view, with partial cut-away for viewing an interior.
Figure 2:
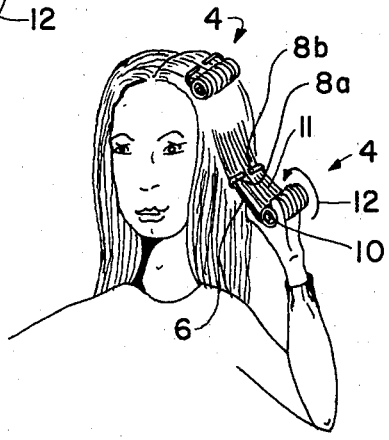
FIG. 2 illustrates in an in-part view diagrammatically a lady wearing one fully rolled curler, while rolling another at a mid-point of retraction, in front perspective view.
Figure 3:
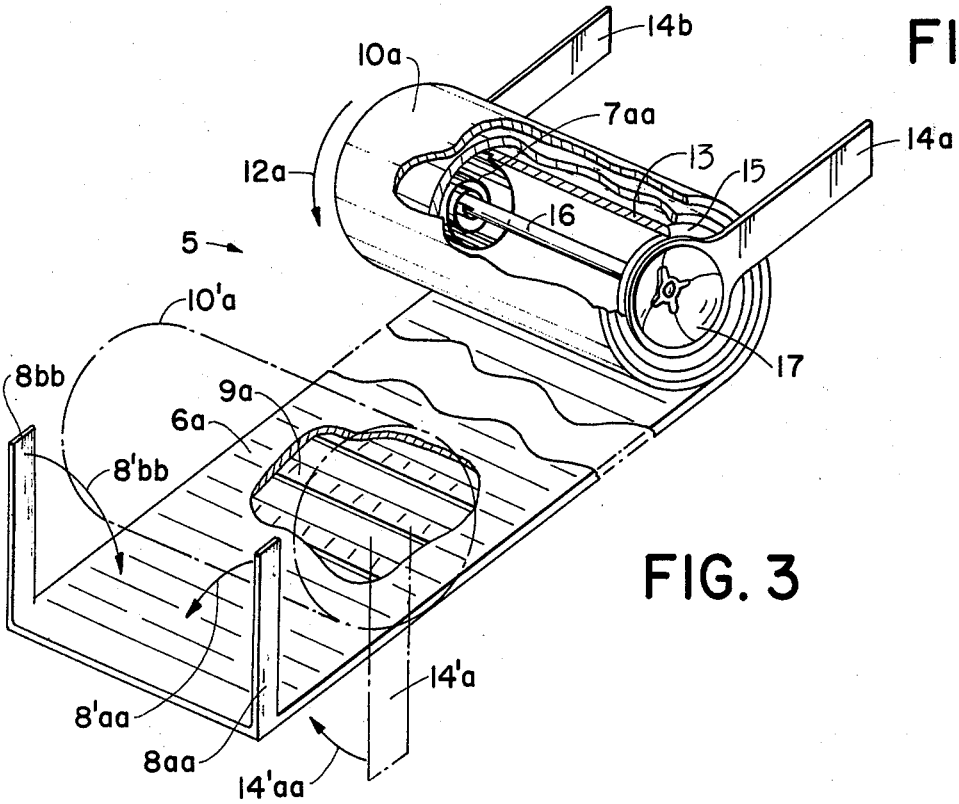
FIG. 3 illustrates in side perspective view and with partial cut-away an alternate embodiment of the invention, in a partially extended state.

In greater detail, FIGS. 1 and 2 illustrte a first embodiment 4 of a hair curler of the present invention, and FIG. 3 illustrates a second embodiment 5 of an alternate hair curler.

In FIGS. 1 and 2, there is illustrated the hair curler embodiment 4 which includes a cover 6 typically and preferably of a heat-resistant-type plastic (or other material), of a substantially flexible nature. While this embodiment illustrates an elongated coil spring 7 extending along the length and accordingly longitudinal axis of the embodiment 4, the spring-mechanism may be an inherent part of the cover 6 if a plastic (or other material) employed is of a resilient and precoiled nature such that whenever uncoiled by force, it will immediately recoil upon itself when the end thereof is released. In the present embodiment of FIGS. 1 and 2, the curler along its width and thereby transverse axis is made rigid substantially, by virtue of rib strips 9, preferably spaced-apart from one-another typically as shown in the cut-away; however, as stated above with regard to a substantially rigid but precoiled flexible plastic, if used (or of other equivalent material), material such as plastic may be formed in a strip from which is inherently substantially rigid along its width transverse axis, but never-the-less is recoilable by self-retraction devoid of either additional rigidity-adding width-extending bars or strips as well as devoid of a coil strip along the length of the elongated strip. Again, in the present embodiment 4, at one end there is a clamping mechanism, namely the bendable clamp elements **8*a* and 8*b* which constitute preferably a part of the enlongated tape itself, and the bendable elements 8*a* is bendable downwardly in a direction 8'*a*, while the clamp element 8*b* is bendable downwardly in a direction 8'*b*, clampable on top of hair laid therebetween on top of the rollable (inside) surface of the tape to be extended along the length of the tape when the tape is uncoiled thereafter. For purposes of improved illustration, the curler embodiment 4 of FIG. 1 is illustrated in a partially-extended state, thus illustrating a partially coiled tape portion 10 recoilable in direction 12. FIG. 2 illustrates the embodiment 4 in approximately the same degree of extension, except as it might appear after having been first mounted on a hair tuft by clamps 8*a* and 8*b* as shown in clamped-down states on top of the hair with the cover 6 having mounted on top thereof on the coilable surface thereof hair 11 extending along a longitudinal length of the embodiment 4, and thus already partially encompassed within the recoiled portion 10**.

FIG. 3 of alternate embodiment 5 has the component parts thereof identified by comparable indicia except for example the cover of FIG. 1 identified as cover 6, being identified in this embodiment 5 as cover **6*a*, and the like for other elements. The major distinction between the embodiment 5 and that of embodiment 4, is that in embodiment 5 there is not necessarily any elongated coil spring extending a length of the elongated tape's longtidinal axis, but alternately there is a coil or other appropriate type spring such as coil spring 7*aa* connected at one end thereof to the coilable end of the elongated strip and connected at an inner end of the coil spring, to a central rod or shaft 16 on which the finger-gripable, preferably inwardly-recessed handle structure 17 is mounted, into which recess the fingers are insertable at each of opposite ends to grasp the curler therebetween finger ends. As an extension from the handle structure, there are clamp elements 14***a* and 14*b* to be utilized after the coiled portion 10*a* has been fully retracted to a fully retracted state with the hair mounted along the coiled elongated tape and thusly embedded within the coil, whereby the clamping elements 14*a* and 14*b* would be positioned as shown for the phantom disclosure of the coiled portion at 10'*a*, whereby the phantom-shown clamps shown typically as phantom clamp 14'*a* is movable clampably in direction 14'*aa* to beneath the elongated (retracted) tape to prevent wrap-around the underside of the cover 6*a*, thus preventing the wound-up coil portion 10'*a* from unwinding (uncoiling) to thereby otherwise lose the hair encompassed therewithin.

While such is not illustrated, it is within the scope of the invention to include metallic portions such as preferably the rib strips 9 themselves being of metallic material, or other heat-retainable and/or conductable substantce(s), and/or to include electric heating wiring and heating element(s) within or on the casing, and/or providing mechanism for inserting within the central port or other portions of the coil heating element(s) for thereby in conventional method or manner facilitating the setting of curl to the hair emcompassed within the coiled embodiment(s) such as typically embodiments 4 and/or 5.

Accordingly, an end of the curler elongated tape may be inserted under a strip of turf of hair which is pulled down already or which is thereafter pulled down along with the uncoiling of a coiled portion, to thereby mount the hair either on top of or beneath the tape. While it is desirable to have the clamps as a part of the elongated tape, the clamp(s) "may" be simply hair pin(s) or any desired design(s); similarly while it is preferable to have a clamp on each of opposite edges of the width of the tape end, one clamp may be utilized. Also, the clamp(s) may be spaced-from the end of the tape and-/or there may be a plurality of clamps on either or both edges along the length or a partial length of the elongated tape. Such clamp(s) assure that the hair will remain in place, as might be desired during a recoiling of the uncoiled tape.

One of the particular benefits of this invention is that once the coiled tape of the curler has been extended to substantially an uncoiled state, the coiling-up recoilably may be effected speedily by merely a release of the lower end thereof for self-coiling with perfect encasement of the hair to be curled. While the cover is preferably of a heat-resistant material, the cover may be of various alternate compositions such as rubber, metal, plastic, or any other appropriate composition or material which may be molded or woven or pressed, whether animal or plant or plastics, etc., as the case may be.

Also, while a coil spring has been typically illustrated for the embodiment 5, any appropriate spring mechanism may be utilized, even to the extent of a simple rubber band as a spring mechanism, thus being of low cost of manufacture as well as low cost of the components thereof.

Accordingly, it may be appreciated, that by the mechanism and structure of the present invention, simplicity is the controlling factor for the present invention, which interprets into low cost of both materials and manufacture, and accordingly low cost to the consuming public as well as having the advantages as already earlier set forth above.

It is within the scope of the present invention to make such variations and modifications and substitution of equivalents as would be apparent to a person having skill in this particular art and field.

Note that in the FIG. 3 embodiment, the coil spring *7aa* is connected at an inner end to the rod or shaft 16, and at the other, outer spring end to the revolvable spool structure 13. The spool structure at each of opposite ends thereof is slidably mounted on the periphery of the circular base portion of the handle 14, the base of the handle being and including the concave portion 17. The slidable annulus portion of the spool structure 13 is illustrated as sleeve end structure 15. The handle 14 is illustrated as handles 14*a* and 14*b*, previously identified as clamping elements 14*a* and 14*b*, thus serving a dual function.

I claim:

1. A hair curler article comprising in combination: an elongated tape element substantially rigid transversely along a width thereof and substantially flexible along a longitudinal axis of its elongated length thereof; and spring means for causing the elongated tape element to become coiled along its longitudinal axis, the spring means comprising a spool element and a central coil spring and handle means for gripping with one's fingers and for anchoring one end of the central spring, said central spring being connected at one end thereof to the spool element and at an opposite end thereof to the handle means, with the tape's end attached to the spool element, adapted to cause strands of hair laid upon the tape element before retraction of the central spring, to become drawn and curled between consecutive coils of the elongated tape in a retracted coiled state, and the handle means including a fastening element bendable to and fro alternately preventable of coiled tape element and entrapped curled hair from uncoiling and when desired releasable of the same, a proximal end of the elongated tape element being fixedly mounted onto said spool element.

2. A hair curler article of claim 1, including a clamping element on a distal end of said elongated tape, positioned for latching retainably around strands of hair laid upon the tape element before retraction of the central spring.

* * * * *